US006165293A

United States Patent [19]

Allan

[11] Patent Number: 6,165,293

[45] Date of Patent: Dec. 26, 2000

[54] THIXOTROPIC IRFNA GEL

[75] Inventor: Barry D. Allan, Huntsville, Ala.

[73] Assignee: The United States of America as represented by the Secretary of the Army, Washington, D.C.

[21] Appl. No.: 06/500,642

[22] Filed: May 26, 1983

[51] Int. Cl.[7] ..... C06B 45/02

[52] U.S. Cl. ..... 149/21; 149/61; 149/74; 149/110; 149/112

[58] Field of Search ..... 149/21, 40, 41, 149/110, 112, 74, 61

[56] References Cited

U.S. PATENT DOCUMENTS

| | | | |
|---|---|---|---|
| 3,921,394 | 11/1975 | Tannenbaum | 149/109.2 |
| 3,925,124 | 12/1975 | Tannenbaum | 149/109.2 |
| 3,942,443 | 3/1976 | Lyles | 60/252 |
| 3,989,560 | 11/1976 | Allan | 149/36 |
| 4,008,170 | 2/1977 | Allan | 252/194 |
| 4,039,360 | 8/1977 | Allan | 149/36 |

*Primary Examiner*—Stephen J. Lechert, Jr.
*Attorney, Agent, or Firm*—Arthur H. Tischer; Freddie M. Bush

[57] ABSTRACT

A thixotropic oxidizer gel comprising inhibited red fuming nitric acid (IRFNA) as the carrier with lithium nitrate ($LiNO_3$) suspended therein and gelled with a gellant agent of $SiO_2$ having a mean particle size of 0.015 microns has the rheological properties which can be tailored to match those of MICOM GEL, a fuel gel.

A thixotropic gelled fuel (MICOM GEL) has been of particular interest because of its increased safety, reduced sloshing, ease of pumping at zero gravity and ability to suspend high concentrations of high-energy ingredients. However, a gelled oxidizer has been desired for use with the gelled fuel to constitute a thixotropic gelled propellant system. The combination of a gelled fuel (MICOM GEL) and a gelled oxidizer is now a reality after the development of the thixotropic oxidizer gel disclosed above. Of major significance is the matching of the rheologial properties of the two gels so that an oxidizer/fuel (O/F) ratio shift does not occur with a temperature change. The development of the thixotropic oxidizer gel obviates the problems of O/F shift attributed to using a liquid IRFNA oxidizer with MICOM GEL. The combination of the thixotropic oxidizer gel comprising the carrier of IRFNA in weight percent amounts from about 55.0 to 86.0, the suspended $LiNO_3$ in weight percent amounts from about 10.0 to 40.0, and the gellant agent of $SiO_2$ in weight percent amounts from about 4.0 to about 5.0 with MICOM GEL fuel offers both high Isp and high density Isp which translates to significant increases in total system performance. This combination reflects a range increase to 160 percent of the present system.

10 Claims, 4 Drawing Sheets

THIXOTROPIC IRFNA GEL

DEDICATORY CLAUSE

The invention described herein may be manufactured, used, and licensed by or for the Government for governmental purposes without the payment to me of any royalties thereon.

BACKGROUND OF THE INVENTION

The first interest in thixotropic gelled propellants was aroused by their obvious advantages of increased safety, reduced sloshing, and ease of pumping at zero gravity conditions. Thixotropic gels also have the ability to stabilize high concentrations of metals or high-energy powdered ingredients in a uniform suspension while still providing the capability to be pumped, injected, and burned as a normal liquid propellant. The incorporation of high-energy ingredients in the gels provides compositions offering the potential of both high Isp and high density Isp which translates to significant increases in total system performance.

An Army program was initiated to develop a gelled fuel to capitalize on these advantages. MICOM GEL, which is a high density, high energy, gel formulation, was developed and has undergone extensive laboratory testing. MICOM GEL has been fired in a LANCE engine system using ungelled Inhibited Red Fuming Nitric Acid (IRFNA) as the oxidizer. All the laboratory and engine test results of MICOM GEL were highly satisfactory. One of the primary reasons MICOM GEL was developed was to provide the Army with a thixotropic gel possessing rheological properties which would permit it to be used within Army environmental limits (−65° F. to +165° F.). The rheological properties of MICOM GEL were shown to be better than previously developed thixotropic gels. However, the viscosity of all thixotropic gels increase more than the viscosity of ungelled or neat propellants. If MICOM GEL was used in a one gel system with ungelled or neat IRFNA as the oxidizer, (without a method of compensating for this inherent viscosity change) an oxidizer/fuel (O/F) shift would occur leading to poor combustion efficiency. In an attempt to overcome this viscosity induced O/F shift, a theoretical and experimental program was initiated at MICOM to evaluate a gelled oxidizer. The oxidizer chosen to evaluate was IRFNA which is a storable oxidizer and is usable throughout the environmental temperature range. It has been extensively used in the LANCE system and has passed all the rigorous environmental and handling tests demanded by this system without any problems. Gelling the oxidizer could result in an advantageous combination with a gelled fuel, such as MICOM GEL, particularly if the oxidizer could be gelled to contain a suspension of powdered ingredients in a uniform concentration. Gelling the oxidizer composition could maintain high Isp, increase density Isp and reduce the oxidizer/fuel shift caused by the difference in viscosity of the oxidizer and fuel.

Therefore, it is an object of this invention to provide a gelled thixotropic oxidizer.

Another object of this invention is to provide a gelled thixotropic oxidizer which has the ability with low gellant concentration to suspend added ingredients in a uniform concentration even when subjected to high-g forces.

A further object of this invention is to provide a gelled thexotropic oxidizer which eliminates or reduces the viscosity shift differences between the fuel and oxidizer while maintaining the safety, ease of pumping at zero gravity and high Isp and density impulse advantages of gels.

SUMMARY OF THE INVENTION

A thixotropic oxidizer gel consisting of Inhibited Red Fuming Nitric Acid (IRFNA) as the carrier with lithium nitrate ($LiNO_3$) suspended in it and gelled with silicon dioxide ($SiO_2$) has rheological properties which can be tailored to match those of MICOM GEL, a fuel gel, or other selected fuel gels. Matching the rheological properties of the fuel gel and the oxidizer gel ensures that an oxidizer/fuel (O/F) ratio shift does not occur with temperature change.

The thixotropic ozidizer gel is comprised of about 4.5 weight percent to about 5.0 weight percent silicon dioxide as the gellant, lithium nitrate additive from about 10.0 weight percent to about 40.0 weight percent, and of about 55.0 weight percent to about 85.5 weight percent inhibited red fuming nitric acid.

With appropriate selection of the $LiNO_3$ and $SiO_2$ concentrations oxidizer gels of desired viscosities can be obtained which will match the viscosities of selected fuel gels.

DESCRIPTION OF THE PREFERRED EMBODIMENT

The thixotropic oxidizer gel of this invention comprises inhibited red fuming nitric acid in an amount from about 55.0 weight percent to about 86.0 weight percent, a gellant agent of $SiO_2$ having a mean particle size of 0.015 microns in an amount from about 4.0 to about 5.0 weight percent, and an additive of $LiNO_3$ in an amount from about 10.0 to about 40.0 weight percent.

The above thixotropic oxidizer gel is useful with a typical thixotropic fuel gel comprised of monomethylhydrazine (MMH) as a carrier. This gelled fuel composition is typically 60 weight percent aluminum, 38.5 weight percent MMH, 1.4 weight percent hydroxy propyl cellulose, and 0.1 weight percent dimethylurea.

Figure 1:
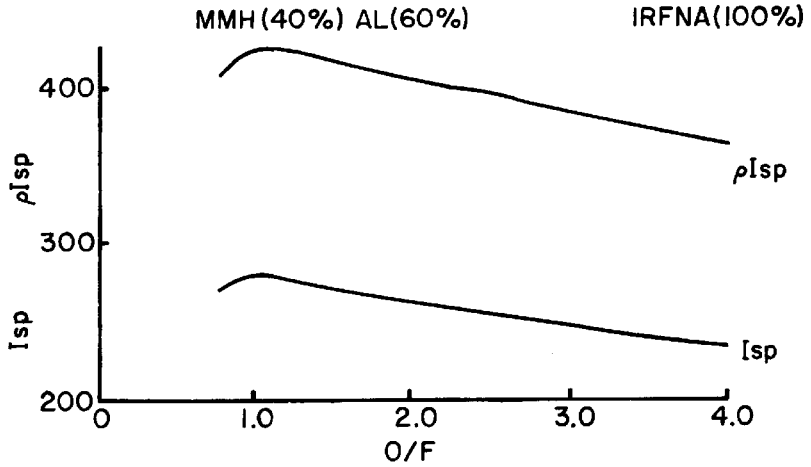
FIG. 1 (PRIOR ART)
FIGS. 1 and 2 are performance curves for prior art combinations of various oxidizer/fuel ratios for a gelled fuel/liquid oxidizer and for a liquid fuel/liquid oxidizer respectivey.
Figure 2:
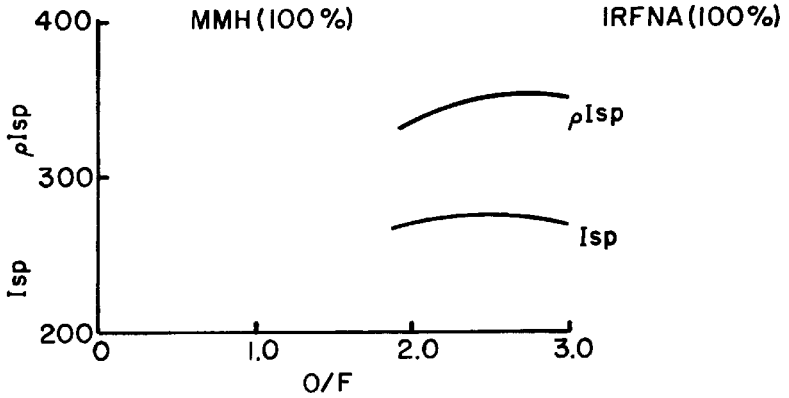
FIG. 2 (PRIOR ART)
Figure 3:
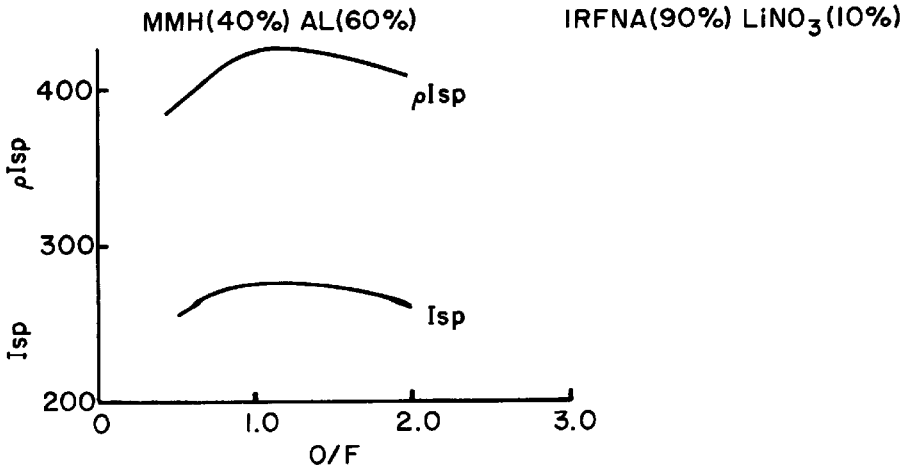
FIGS. 3–6 are performance curves for the thixotropic oxidizer gels of this invention comprising inhibited red fuming nitric acid with variable amounts of $LiNO_3$ additive in combination with a gelled fuel at various oxidizer/fuel ratios.
Figure 4:
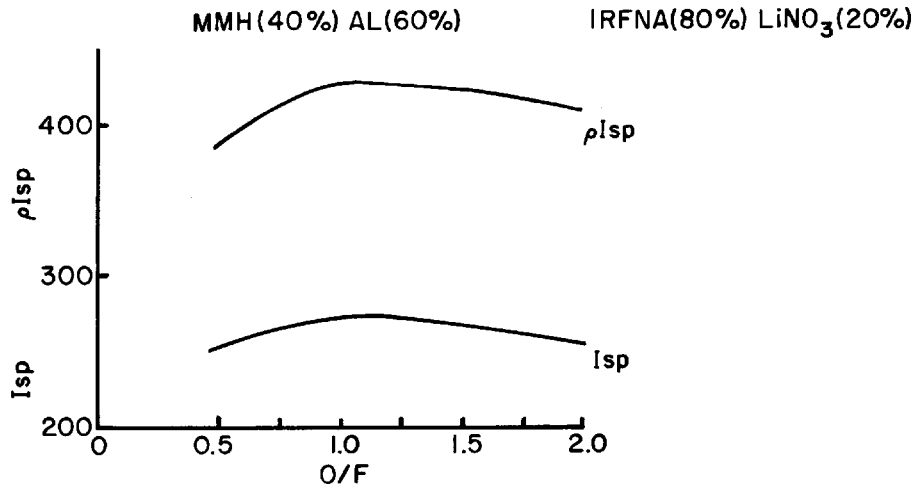

Preliminary experimental work to develop a gelled propellant system (i.e., gelled fuel and gelled oxidizer) was concerned with performance evaluation of a gelled fuel, such as MICOM GEL, with neat IRFNA. This performance evaluation is shown in FIG. 1. Another performance evaluation related to neat monomethyl hydrazine with IRFNA. This performance evaluation is shown in FIG. 2. Table I (below) sets forth the values for the data plotted in FIGS. 1 and 2. The maximum Isp can be seen to be approximately the same with a slight advantage to the gelled system but, in the case of the density impulse (ρIsp), the gelled system provides a significant advantage. In a volume-limited system the density impulse advantage can provide a range or payload increase. The objective was then focused on developing an oxidizer gel which would eliminate or reduce the viscosity shift differences between the fuel and oxidizer while maintaining the safety, ease of pumping at zero gravity and high Isp and density impulse advantages of gels.

TABLE I

Isp AND ρIsp VS O/F

| | MICOM GEL/ IRFNA (neat) | | MMH/IRFNA | |
|---|---|---|---|---|
| O/F | Isp | ρIsp | Isp | ρIsp |
| .75 | 270.6 | 408.5 | — | — |
| 1.0 | 281.0 | 426.3 | — | — |
| 1.5 | 273.5 | 417.7 | — | — |
| 2.0 | 264.9 | 406.4 | 269.6 | 334.0 |
| 2.5 | 256.7 | 395.2 | 273.7 | 349.5 |
| 3.0 | 248.7 | 383.7 | 266.5 | 348.5 |

The next experimental work related to determining a suitable gellant and additive for IRFNA. This work covered a search for gellants and additives which could be used with IRFNA. The reactivity and compatibility of IRFNA with organic gellants such as those used in MICOM GEL eliminated them as practical gelling agents for the oxidizer gel. A preliminary evaluation of silicon dioxide ($SiO_2$) showed that it could be used as a gellant for IRFNA and it was selected for evaluation. Because $SiO_2$ is fully oxidized and would not participate in the combustion process as would the organic cellulose gellants, it is desirable to minimize its concentration. A minimum gel concentration would not provide a sufficient viscosity increase to the oxidizer in comparison to the fuel containing 60 percent aluminum. An additional additive that would be both compatible and non-reactive with IRFNA was needed. It would be advantageous if such an additive would contribute to the impulse and density impulse or, at least, not degrade the performance of the overall system.

Figure 5:
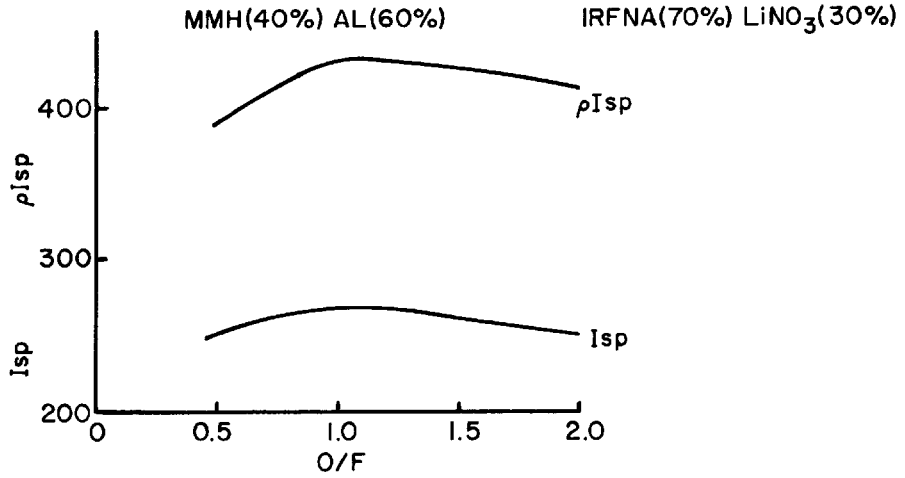
Figure 6:
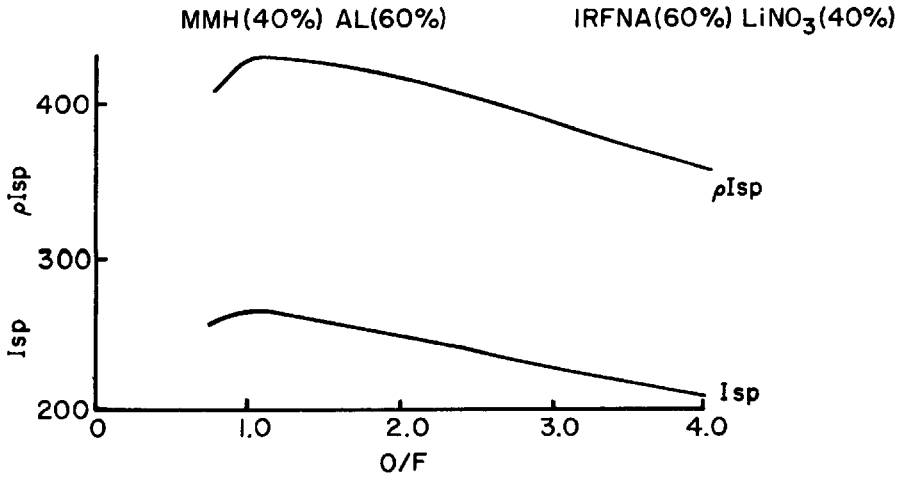

A number of additives were considered and rejected for various reasons. One additive that looked attractive was lithium nitrate ($LiNO_3$). A series of performance curves were run for 10%, 20%, 30%, and 40% $LiNO_3$ in IRFNA. The results of these runs are presented in FIGS. 3 through 6. Thus, the performance curve, for example, in FIG. 5, IRFNA-30%/MICOM GEL comprises the oxidizer IRFNA with 30% $LiNO_3$ additive in combination with MICOM GEL fuel. The peak Isp value for the $LiNO_3$ system falls slightly as the percent of $LiNO_3$ is increased, but the density impulse increases slightly. Table II (below) gives the values for data plotted in FIGS. 3 through 6.

TABLE II

Isp AND ρISP VS O/F

| | MICOM GEL/ 10% $LiNO_3$ IRFNA | | MICOM GEL/ 20% $LiNO_3$ IRFNA | | MICOM GEL/ 30% $LiNO_3$ IRFNA | | MICOM GEL/ 40% $LiNO_3$ IRFNA | |
|---|---|---|---|---|---|---|---|---|
| O/F | Isp | ρIsp | Isp | ρIsp | Isp | ρIsp | Isp | ρIsp |
| .50 | 256 | 389.1 | 254.5 | 389.4 | 252.5 | 391.4 | 250.2 | 392.6 |
| .75 | 266.0 | 406.9 | 267.9 | 407.5 | 259.1 | 409.4 | 256.1 | 409.6 |
| 1.0 | 277.0 | 426.6 | 274.2 | 430.5 | 270.2 | 432.3 | 266.5 | 432.7 |
| 1.5 | 269 | 419.6 | 266.3 | 423.4 | 262.1 | 424.6 | 258.4 | 428.7 |
| 2.0 | 261 | 414.7 | 257.0 | 413.8 | 252.5 | 416.6 | 248.6 | 418.5 |

The ideal concentration of $LiNO_3$ in the oxidizer was unknown at this time and depends on the experimentally determined viscosity of the oxidizer and an overall system evaluation of Isp, ρIsp and viscosity.

EXPERIMENTAL EVALUATION

The actual formulation of an oxidizer gel was, of necessity, determined after much experimental effort. The many hundred laboratory samples prepared and tested on MICOM GEL served as a basis for reducing the search for suitable additions and gellants for the oxidizer gel. Also, the previous efforts had developed tests and techniques which were used in the testing of the oxidizer gel.

The first tests performed toward developing an oxidizer gel were to determine the solubility and compatibility of $LiNO_3$ in IRFNA. A solubility of 0.0063 gm/cc was determined experimentally by forming a saturated solution and evaporating off the IRFNA. This minimum solubility would not be a problem in the gel.

The IRFNA has, as inhibitor, approximately 0.5 percent hydrofluoric acid (HF). Hydrofluoric acid is known to react with glass. The gellant selected for the oxidizer gel was $SiO_2$ which is the same chemical composition as glass. The reaction of the gellant $SiO_2$ and HF is as follows:

$$SiO_2+4HF \rightarrow SiF_4+2H_2O$$

The gellant is commercially available under the name of Cab-O-Sil with a mean particle size of 0.015 microns. The fine particles should react quickly with IRFNA. An experiment was set up to collect the gases after the addition of IRFNA to gellant ($SiO_2$). The reaction took place quickly and seemed to stop. The gas was analyzed with a Hewlett-Packard 5930 Mass Spectrometer and found to be $SiF_4$, as predicted. Because the reaction takes place quickly upon the addition of IRFNA, it would take place during the mixing of the gel and would be complete before the gel was loaded into a missile. Therefore, no long term storage problems should be encountered in the missile system. In fact, no pressure build-up has been noted in the laboratory samples stored between tests.

It was found that between 4 and 5 percent gellant and 10 and 40 percent $LiNO_3$ mixed well and produced homogeneously appearing gels. It was found in previous testing that many of the combinations of ingredients formulated in the development of MICOM GEL which appeared stable after mixing would separate or settle with storage, vibrations, or high-g loadings. An empirical test developed during the fuel research demonstrated that the failure of a composition to settle after 30 minutes at 500 g's acceleration was a good indication that little or no settling would occur during storage. Therefore, the next series of tests were directed at determining if any settling took place at 500 g's for 30 minutes using IRFNA gels. IRFNA gels with 10 percent, 20 percent, 30 percent, and 40 percent $LiNO_3$ were prepared with 4 percent, 4.5 percent, and 5 percent gellant. All samples with 4 percent gellant were found to separate or settle during the test but those with 4.5 or 5.0 percent gellant passed the test. As with MICOM GEL, the IRFNA gel shows a very thin (~1.0 mm) layer on top which is caused by the evaporation and condensation of vapor onto the surface. This thin layer will not effect the usefulness of the gel.

The density of the IRFNA gels was measured using 2.5 ml glass stopped graduated test tubes. IRFNA is much harder to handle than standard laboratory liquids because of the release of $NO_2$ from the sample. The density of the gels was determined for 20 percent, 30 percent, and 40 percent $LiNO_3$ gels. The values are in the 1.7 to 2.0 g/cc range. Some difficulty has been encountered in obtaining a narrower range of accuracy values for these gels because of handling and mixing problems. However, more accurate results are projected as these problems are solved.

The initial gels were prepared by grinding the $LiNO_3$ with a mortar and pestle. The particle size of this material was determined to be between 5 microns and 100 microns. These particles varied in size more than was desired and it was difficult to get uniform batches. The $LiNO_3$ used in all the later gels was ground in a ball mill for 96 hours under freon. The particle size of this material is between 3 microns and 30 microns.

Figure 7:
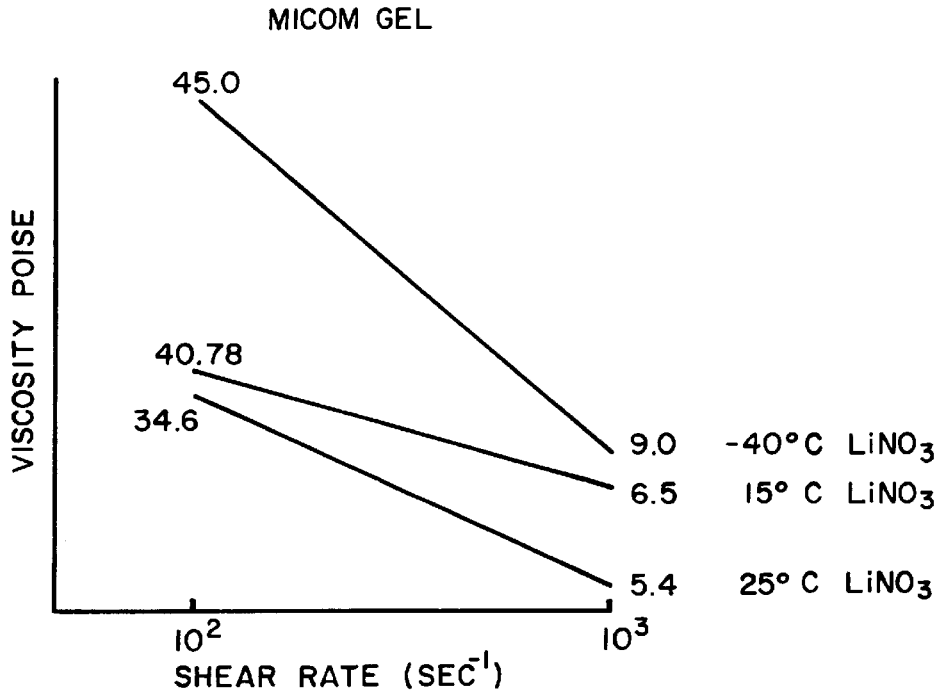
FIG. 7 is a viscosity curve for a prior art gelled fuel.

The next step in developing an IRFNA gel was to determine the viscosity of the various formulations. The viscosity of the IRFNA gels can be compared to those of MICOM GEL which are shown in FIG. 7. The viscosities were obtained with a Ferrranti-Shirley Viscometer. The viscometer is housed and used in a hood because of the toxicity and reactivity of the ingredients.

Figure 8:
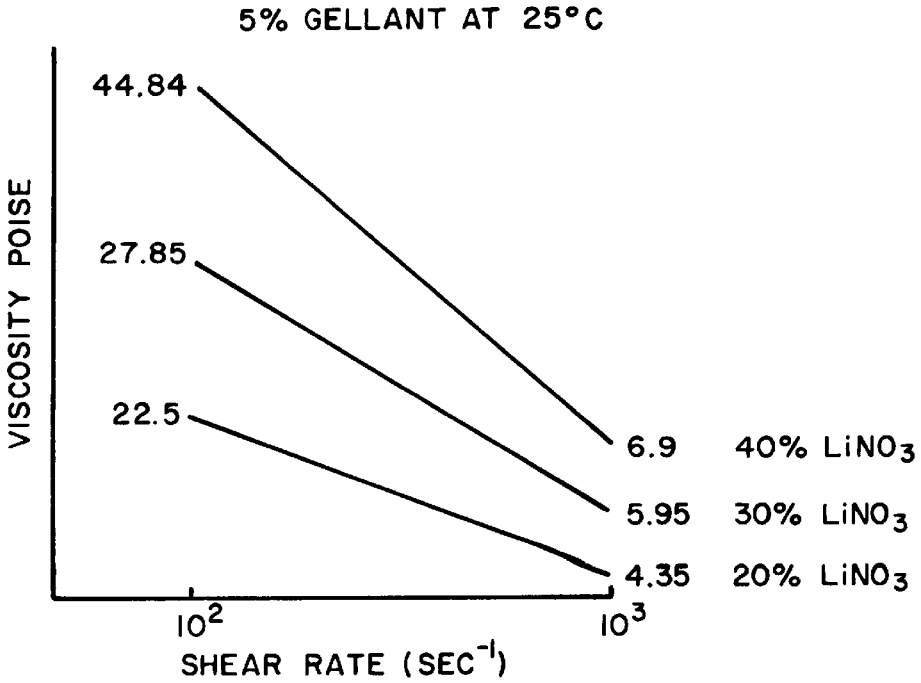
FIGS. 8–10 are viscosity vs shear rate ($sec^{-1}$) curves for the thixotropic oxidizer gels of this invention comprising inhibited red fuming nitric acid gelled with $SiO_2$ and containing variable amounts of $LiNO_3$ additive.
Figure 9:
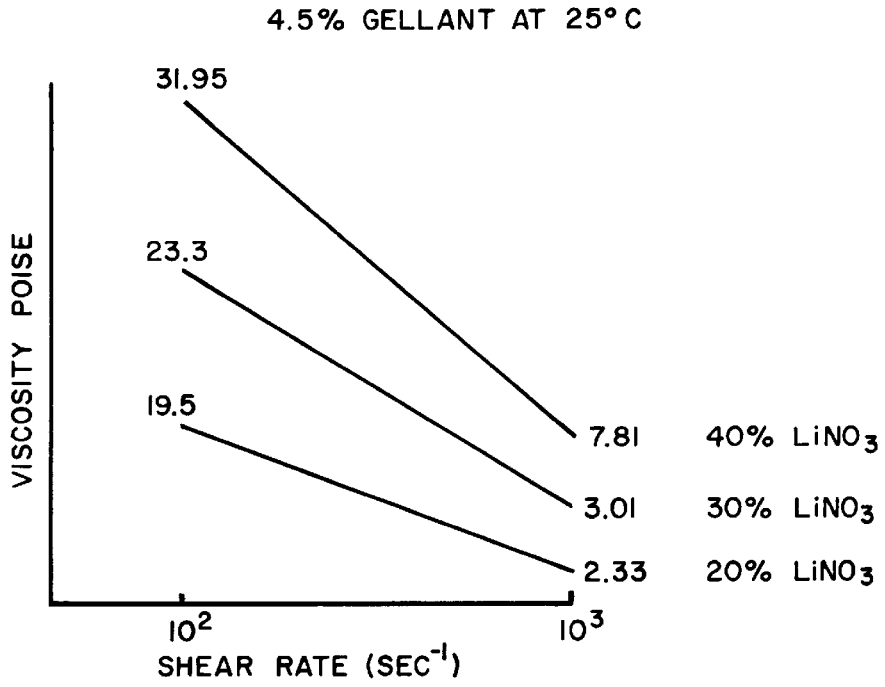

FIG. 8 is a plot of data from Table III (below) of the viscosity of an IRFNA gel with 5 percent $SiO_2$ at 25° C. The data shown in Table III shows that as the concentration of $LiNO_3$ is increased from 20 percent to 40 percent, the viscosity increases. Comparing FIG. 8 and FIG. 7 (MICOM GEL) it can be seen that an IRFNA gel with between 30 percent and 40 percent $LiNO_3$ has a viscosity similar to that of MICOM GEL at 25° C. Decreasing the gellant concentration to 4.5 percent (FIG. 9) produces a gel at 40 percent $LiNO_3$ which is very similar to MICOM GEL (FIG. 7).

TABLE III

VISCOSITY OF IRFNA GELS

| | | |
|---|---|---|
| | 5% $SiO_2$ @ 25° | |
| 20% $LiNO_3$ | 22.5 | 4.35 |
| 30% $LiNO_3$ | 27.85 | 5.95 |
| 40% $LiNO_3$ | 44.84 | 6.90 |
| | 5% $SiO_2$ @ 35° | |
| 20% $LiNO_3$ | 23.8 | 2.18 |
| 30% $LiNO_3$ | 25.4 | 3.09 |
| 40% LiNO | 31.4 | 3.47 |
| | 4.5% $SiO_2$ @ 25° | |
| 20% $LiNO_3$ | 19.5 | 2.33 |
| 30% $LiNO_3$ | 23.3 | 3.01 |
| 40% $LiNO_3$ | 31.95 | 7.81 |
| | 4.5% $SiO_2$ @ 20° | |
| 20% $LiNO_3$ | 27.85 | 2.80 |
| 30% $LiNO_3$ | 41.05 | 3.01 |
| 40% $LiNO_3$ | 56.78 | 4.92 |
| | 4.5% $SiO_2$ @ 35° C. | |
| | $10^2$ | $10^3$ |
| 20% $LiNO_3$ | 16.6 | 2.8 |
| 30% $LiNO_3$ | 29.4 | 2.3 |

Figure 10:
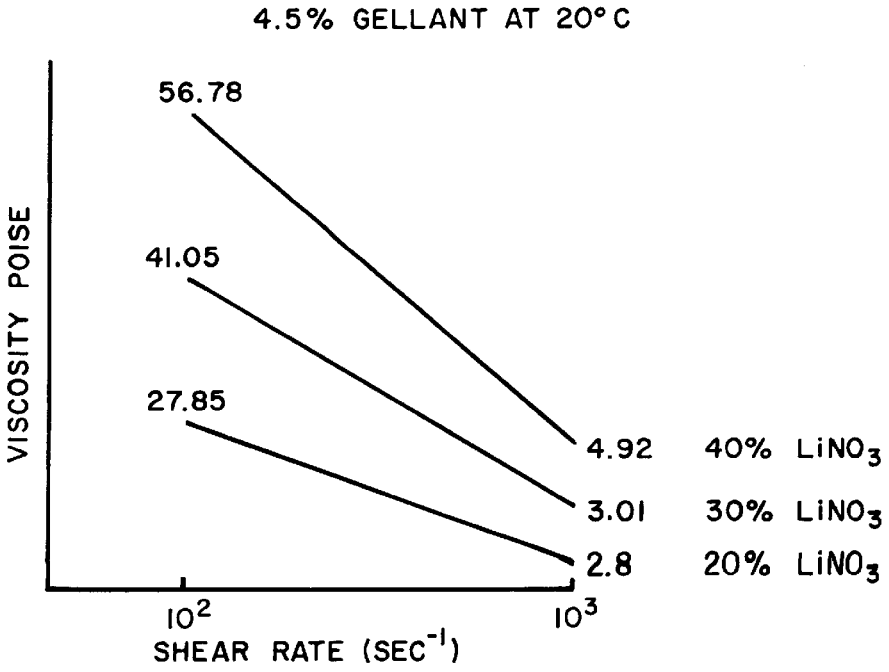

Decreasing the temperature to 20° C. produced higher viscosities in the IRFNA gels as expected. At 40 percent $LiNO_3$ the $SiO_2$ gel viscosity (FIG. 10) is higher than MICOM GEL at low shear rate ($10^2$) but lower at high shear rate ($10^3$).

DISCUSSION AND CONCLUSION

The experimental results obtained with IRFNA gel formulations show that stable thixotropic gels can be prepared using $SiO_2$ as a gellant. By suspending $LiNO_3$ in the IRFNA gel a high-energy ingredient is incorporated which retains a high Isp and provides a density Isp slightly greater than the one gel system using MICOM GEL and neat (ungelled) IRFNA. IRFNA gels containing $LiNO_3$ can be prepared with a viscosity similar to MICOM GEL (FIGS. 7, 8, 9, and 10). Similarly, by appropriate selection of the $LiNO_3$ and $SiO_2$ concentrations, one can match the visosity of other fuel gels, such as for example, one containing 45% aluminum. The similarity of viscosities would eliminate the O/F ratio shift associated with a one gel system.

The IRFNA gels of this invention have been prepared in small batches, however, based on experience with MICOM GEL, scaling-up the size of batches should oppose no problem for using IRFNA gels in a large propellant system. As the IRFNA gels are scaled-up to produce larger batches with more homogeneous distributions of gellant and additive, slight differences in viscosities and other properties can be expected. These slight changes were noted in the development of MICOM GEL. After developing the mixing procedures for large batches of MICOM GEL, a total of approximately 2500 lbs of gel was prepared with consistent properties which varied only slightly from the properties of the smaller samples. If, as expected, the IRFNA gels produce similar results, the properties of the IRFNA gels can be tailored to match closely the properties of MICOM GEL. Therefore, it is anticipated that thixotropic gels of both fuel and oxidizer would be available for use in future Army missile systems.

I claim:

1. A gelled oxidizer composition consisting of inhibited red fuming nitric acid in an amount of about 55.0 to about 86.0 weight percent, ball mill ground $LiNO_3$ of particle size range from about 3 microns to about 30 microns in an amount of about 10.0 to about 40.0 weight percent, and $SiO_2$ having a mean particle size range of about 0.015 microns in an amount of about 4.0 to about 5.0 weight percent.

2. The gelled oxidizer composition of claim 1 consisting of said inhibited red fuming nitric acid in amount of about 85.0 weight percent, said $LiNO_3$in an amount of about 10.0 weight percent, and said $SiO_2$ in an amount of about 5.0 weight percent.

3. The gelled oxidizer composition of claim 1 consisting of said inhibited red fuming nitric acid in an amount of about 85.5 weight percent said $LiNO_3$ in an amount of about 10.0 weight percent, and said $SiO_2$ in an amount of about 4.5 weight percent.

4. The gelled oxidizer composition of claim 1 consisting of said inhibited red fuming nitric acid in an amount of about 75.0 weight percent, said $LiNO_3$ in an amount of about 20.0 weight percent, and said $SiO_2$ in an amount of about 5.0 weight percent.

5. The gelled oxidizer composition of claim 1 consisting of said inhibited red fuming nitric acid in an amount of about 75.5 weight percent, said $LiNO_3$ in an amount of about 20.0 weight percent, and said $SiO_2$ in an amount of about 4.5 weight percent.

6. The gelled oxidizer composition of claim 1 consisting of said inhibited red fuming nitric acid in an amount of about 65.5 weight percent, said $LiNO_3$ in an amount of about 30.0 weight percent, and said $SiO_2$ in an amount of about 4.5 weight percent.

7. The gelled oxidizer composition of claim 1 consisting of said inhibited red fuming nitric acid in an amount of about 65.0 weight percent, said $LiNO_3$ in an amount of about 30.0 weight percent, and said $SiO_2$ in an amount of about 5.0 weight percent.

8. The gelled oxidizer composition of claim 1 consisting of said inhibited red fuming nitric acid in an amount of about 55.5 weight percent, said $LiNO_3$ in an amount of about 40.0 weight percent, and said $SiO_2$ in an amount of about 4.5 weight percent.

9. The gelled oxidizer composition of claim 1 consisting of said inhibited red fuming nitric acid in an amount of about 55.0 weight percent, said $LiNO_3$ in an amount of about 40.0 weight percent, and said $SiO_2$ in an amount of about 5.0 weight percent.

10. The gelled oxidizer composition of claim 1 wherein said inhibited red fuming nitric acid, said $LiNO_3$, and said $SiO_2$ form said gelled oxidizer characterized by having a viscosity range from about 2.0 poises to about 45.0 poises at about 25° C. when measured with shear rates per second of about $10^3$ to about $10^2$, said viscosity range resulting from selecting the ratio of said inhibited red fuming nitric acid, said $LiNO_3$, and said $SiO_2$ within said weight percent ranges specified to achieve the viscosity of said gelled oxidizer to enable it to be matched with the viscosity of a selected gelled fuel composition with which said gelled oxidizer is to be used.

* * * * *